United States Patent [19]

Sperr, Jr. et al.

[11] 4,379,712

[45] Apr. 12, 1983

[54] EVAPORATIVE COOLER

[76] Inventors: Charles J. Sperr, Jr.; Douglas C. Sperr, both of 8432 E. Wilshire Dr., Scottsdale, Ariz. 85257

[21] Appl. No.: 295,638

[22] Filed: Aug. 24, 1981

[51] Int. Cl.[3] ..... B01D 50/00

[52] U.S. Cl. ..... 55/257 R; 55/233; 62/314; 62/DIG. 16; 98/30; 261/26; 261/29; 261/30; 261/106; 261/DIG. 3

[58] Field of Search ..... 55/233, 257 R, 257 MP; 261/30, 105, 106, 111, 112, 116, DIG. 3, DIG. 4, DIG. 15, DIG. 41; 62/314, 315, DIG. 16; 98/2.11, 2.14, 30

[56] References Cited

U.S. PATENT DOCUMENTS

| | | | |
|---|---|---|---|
| 743,528 | 11/1903 | Le Reau | 55/257 MP |
| 816,371 | 3/1906 | Platz | 261/DIG. 3 |
| 917,185 | 4/1909 | Taylor | 261/DIG. 3 |
| 2,035,628 | 3/1936 | Whitmer et al. | 261/DIG. 15 |
| 3,193,259 | 7/1965 | Liebmann | 261/DIG. 15 |
| 3,606,982 | 9/1971 | Anderson | 261/DIG. 4 |
| 4,040,824 | 8/1977 | Kinney, Jr. | 261/112 X |
| 4,234,526 | 11/1980 | Mackay et al. | 261/DIG. 4 |
| 4,309,365 | 1/1982 | Van Ness et al. | 261/DIG. 3 |

*Primary Examiner*—Richard L. Chiesa
*Attorney, Agent, or Firm*—Don J. Flickinger

[57] ABSTRACT

A shroud, including a shield placed on either side of an evaporation pad, increases the length of travel air transit time within the pad. Pressurized water, emitted in jets from a plurality of orifices spaced along a manifold, is directed against a diffuser for dissipation and dissemination to the upper edge of the pad. The pad is wetted intermittently as the result of a timer controlling distribution of the water. An auxiliary reservoir, in combination with relocatable pump, inlet valve and pad frames, provide for alternate downdraft as side draft operation. An elongate, arcuate baffle downstream of the evaporative pad alters the direction of the air stream to flow in a substantially opposite direction.

4 Claims, 23 Drawing Figures

FIG. 1
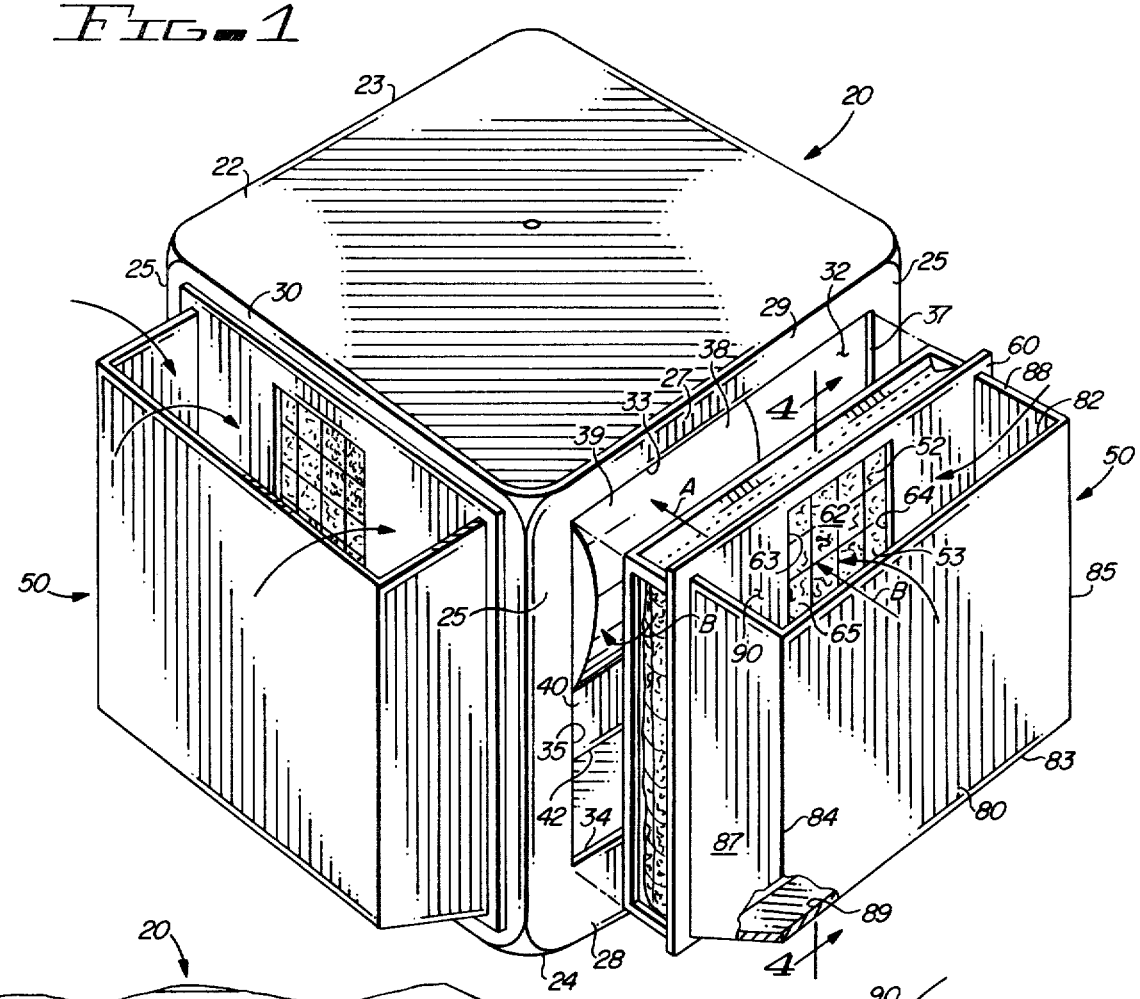
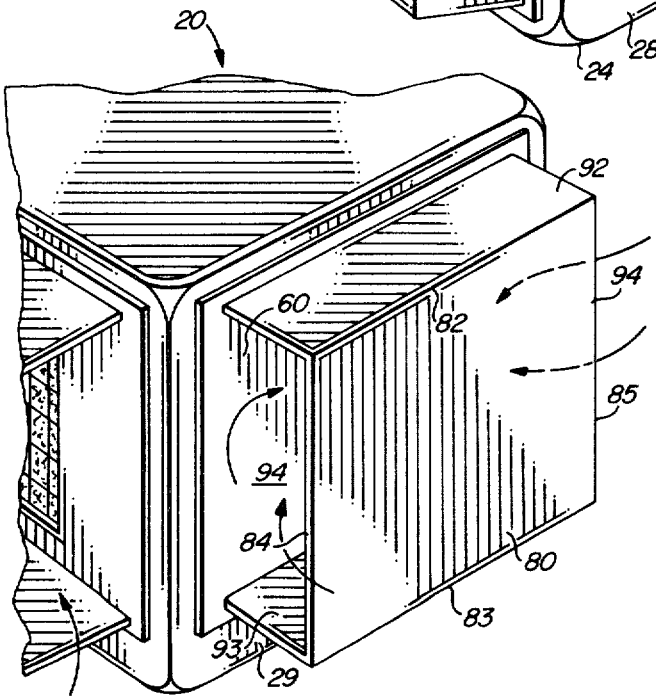
FIG. 2
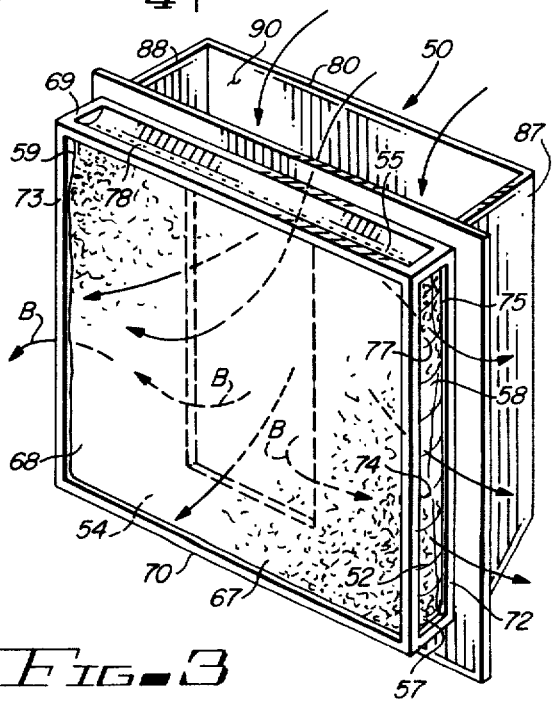
FIG. 3

FIG. 12
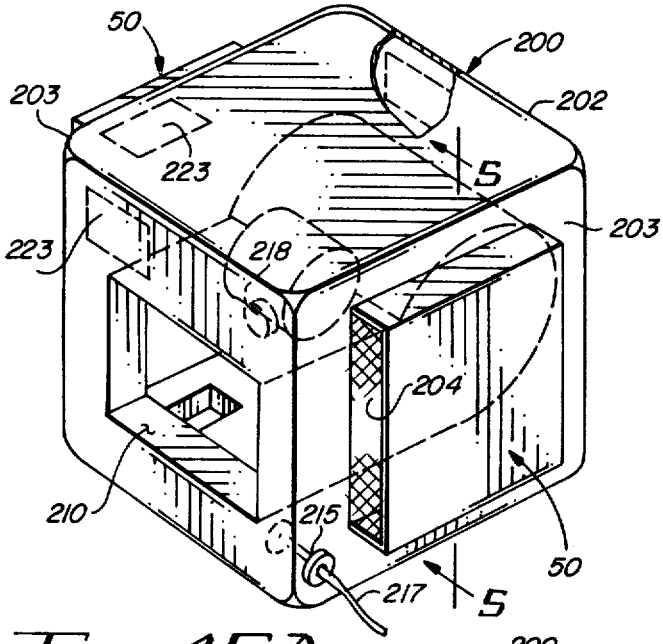
FIG. 16
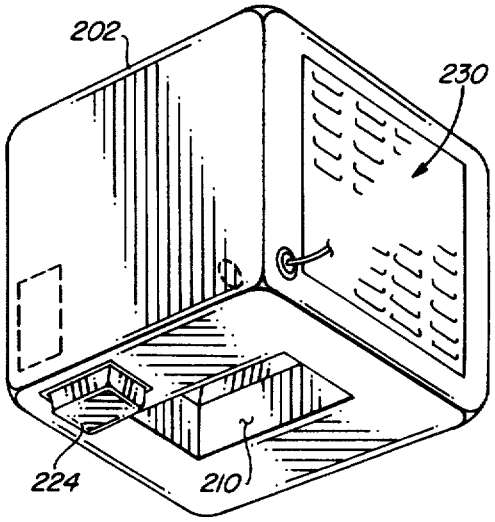
FIG. 15A
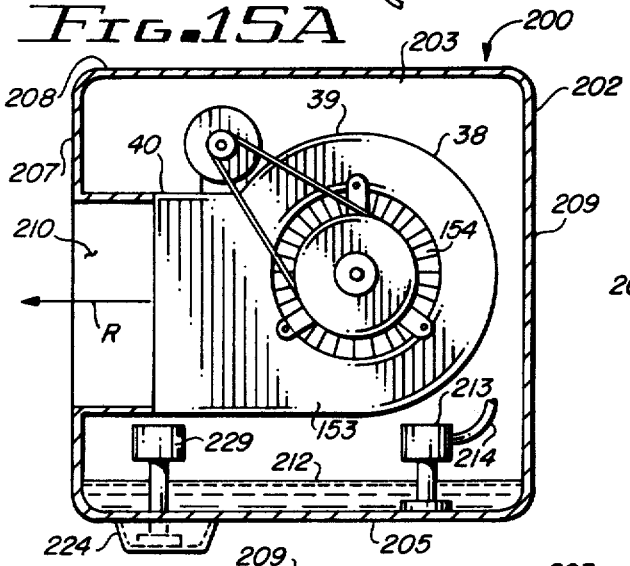
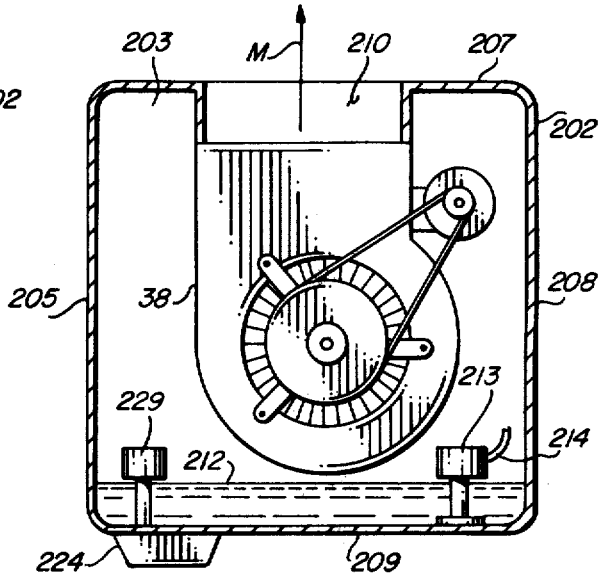
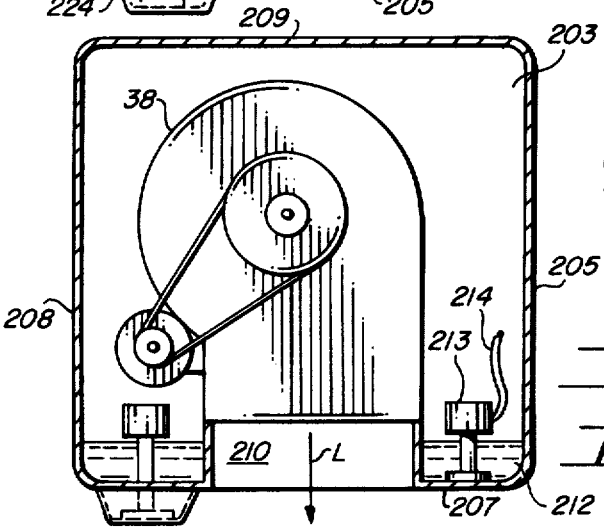
FIG. 15B
FIG. 15C
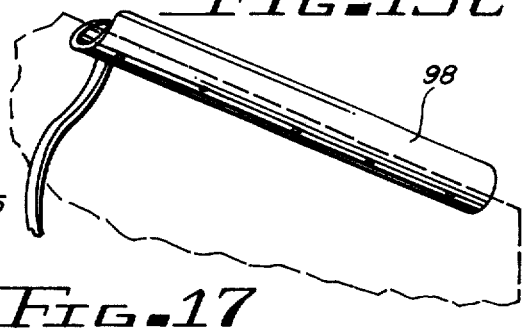
FIG. 17

EVAPORATIVE COOLER

FIELD OF THE INVENTION

This invention relates to air conditioning devices.

In a further aspect, the present invention relates to evaporative coolers of the type having wettable, air permeable pads.

More particularly, the instant invention concerns means for increasing the efficiency and utility of evaporative coolers.

PRIOR ART

The evaporative cooler is a common means of providing cool air to a space, usually an enclosure such as a residence. Due to certain inherent desirable characteristics, such as the requirement for substantially less energy input than compressor operated refrigeration units, the evaporative cooler is exceedingly popular, especially in arid or semi-arid regions. Other desirable features include periodic air exchange within the space and the introduction of moisture into overly desiccated air. Evaporative coolers are also relatively inexpensive to purchase and comparatively simple and economical to install and maintain.

In general, evaporative coolers are available in two primary configurations. Based upon discharge direction of the cooled air, evaporative coolers are broadly classified as either downdraft delivery or side-draft delivery. Down-draft delivery coolers are usually mounted upon a building or other structure, discharging cooled air downwardly through an opening in the roof. Side-draft coolers, which are especially adapted for attachment to an upright surface, are also employed in open areas to direct air to a designated locale such as a work station. With suitable ducting, down-draft and side-draft coolers are interchangeably employable.

Commonly, conventional commercially available evaporative coolers include a generally box-like housing which serves as the main frame. Angular corners, extending between the top and the bottom, define upright open sides. A pad assembly, including a louvered frame holding a water wettable, air permeable pad, spans the opening in each side. The pads are fabricated of a saturatable material such as aspen fiber.

The bottom, having an upturned peripheral edge upon which the pad assemblies rest, functions as a reservoir for retaining the coolant liquid, usually water. A pump transfers the liquid from the reservoir to a distribution system for delivery to the pads. Traditionally, a trough extends along the upper portion of each louvered frame. Water, flowing from a delivery tube, passes through spaced openings in the bottom of the trough and gravitates downwardly through the pad.

Located within the housing is a blower which draws a stream of air through each of the several pads and discharges the air through a common duct communicating with the space to be cooled. The typical blower includes a centrifugal impeller rotatably mounted within a housing having an air inlet aligned with either end of the impeller. An electric motor, usually mounted upon the housing, rotates the impeller by means of a belt drive. The blower and the pump are energized simultaneously in response to the closing of a remote switch. The switch may be activated manually or in response to an environmentally sensitive control.

Theoretically, the pads are of uniform density and saturated with water. As the air moves through the pads, water is evaporated to absorb a portion of the heat within the air. Moisture content of the air is also raised. A float, sensing the water level within the reservoir, controls an inlet valve to compensate for losses due to evaporation.

In addition to designation by design configuration based upon direction of air delivery, evaporative coolers are referenced by a size related to the air flow capacity. The capacity is given in cubic feet per minute (cfm). The designated, or rated cfm, however, is the nominal value and may vary significantly from the certified capacity.

For a more comprehensive understanding of prior art evaporative coolers, example is made of a statistic test model. The model incorporates a specific unit currently being produced by a major manufacturer. The exemplary unit is mounted upon the roof of a typical private residence in accordance with techniques considered to be standard within the art. The geographical setting is Phoenix, Arizona.

The characteristics described below, in connection with the unit, are taken from literature supplied by the manufacturer. Other input parameters were gathered from various public sources and from empirical observation. Output, or performance data, is the result of a computer model based upon the foregoing. The data, set forth as exemplary of the current state of the art, is herein presented for immediate purposes of orientation and subsequent purposes of providing a standard of comparison in connection with the ensuing description of the improvements contemplated by the present invention.

The specific evaporative cooler unit selected for discussion is a down-delivery type having a designated or nominal capacity of 6500 cfm. Literature supplied by the manufacturer sets forth the certified air flow at 4900 cfm. Being generally cubical, the housing carries a pad in each of the four upright sides. Water level within the reservoir is maintained by a float actuated valve. Supplied with water from perforate overhead troughs at a rate to maintain wetness, the pads are exposed on one side to the environment.

Air is moved by an impeller driven by a 0.75 horsepower electric motor. Being of conventional configuration, the impeller receives air through a circular opening, or eye, at either end. Air is discharged centrifugally into an encircling housing having an outlet. The eyes of the impeller embrace an area of 427 square inches, through which the air passes at a velocity of 1652 feet per minute. The velocity of air measured in the approximate 400 square inch outlet duct is 1764 feet per minute.

The inlet area, the total measurement of openings in the four sides normally spanned by the water absorbing, air permeable pads, is 4244 square inches. Assuming a uniform air flow, velocity through the 1.5 inch average thickness pads is 166 feet per minute. Calculated transit time, residence duration of air within the pads, is 0.045 seconds.

Standards for space cooling systems are established by the American Society of Heating Refrigerating and Air-Conditioning Engineers (ASHRAE). Based upon the ASHRAE 1% criteria, a system for Phoenix, Arizona includes a design dry bulb rating of 109° F. and a mean coincident wet bulb rating of 71° F. Also assumed is standard barometric pressure of 28.86 inches of mercury. An evaporative cooler, the type chosen for discussion having a 4900 cfm fan capacity, is commonly used in connection with a typical residential heat load of 3 tons. The specific air flow, given by the formula fan capacity in cfm/head load in tons, equals 4900/3 or 1633 cfm/ton.

An evaporative cooler is a relative cooling device. That is, an evaporative cooler cannot receive ambient air of any existing condition and cool the air to any selected temperature. An evaporative cooler can produce a maximum temperature drop limited by the ambient air wet bulb temperature. The foregoing described test unit, operating under conditions as set forth above, has a rated temperature drop of 30.4° F. for an output temperature of 78.6° F., according to the manufacturer's published data.

The conventional definition of evaporative efficiency is given by the formula:

$$EF = 100 \times \frac{(Tdb - Tc)}{(Tdb - Twb)} \%$$

where:

Tdb=ambient air dry bulb temperature

Twb=ambient air wet bulb temperature

Tc=evaporative cooler discharge temperature.

Utilizing the above data, it is seen that the evaporative efficiency of the test model is 80%.

Evaporative coolers are not generally used in connection with recirculating air systems. The cooled air from the unit is usually vented to atmosphere at a location opposite the inlet location of the space to be cooled. As a result of absorbing the heat within the space, the temperature of the air is increased. Assuming a typical residential heat load of 3 tons in Phoenix, Arizona, with the above design criteria, the room exit temperature of the air will be 86.1° F., reflecting a rise of 7.5° F. The wet bulb temperature within the space will be 73.1° F.

Utilizing the foregoing data, the theoretical limits for an evaporative cooler operating at 100% efficiency can be calculated. Such a cooler, unknown at this time, would decrease the temperature of the ambient air 38.0° F. to provide a discharge of 71.0° F. Passing through the space to be cooled, the air would rise 7.3° F. to an exit temperature of 78.3° F. The wet bulb reading taken within the cooled space would be 73.0° F.

Various factors are responsible for the discrepancy between the ideal limits of 100% evaporative efficiency and the industry standard of 80% evaporative efficiency. Certain differences are due, at least in part, to the inherent characteristics of conventional prior art coolers. Significant among these are pad thickness, air velocity through the pads, and transit time of the air through the evaporative media. The standard 80% evaporative efficiency assumes optimum operating conditions for the test unit evaporative cooler. Other factors impair the function and serve to decrease performance to a level substantially below optimum. Exemplary are various factors such as air and water-borne chemicals and particulates and direct and reflected radiation which deteriorate the pads, materially reducing the absorption ability and disturbing the air flow characteristics.

Conventional means of wetting the pads further contributes to the inefficiency of the typical cooler. Sections of the pad, intermediate the openings in the trough, are not provided with adequate water. Originating from finite sources, the water tends to define a plurality of rivulets, the paths of which decrease in width as the pad ages and deteriorates. Further, observation has shown that continuous wetting is not optimum.

In addition to the foregoing, evaporative coolers mounted in close proximity to certain other structures, such as a unit resting upon the roof of a residence, are additionally burdened. Temperatures immediately above the roof are substantially elevated above ambient. Empirical observation indicates that the air received by a roof mounted unit is approximately 6° to 7° F. warmer than the air received by a remotely located unit. Since the unit is responsible for a given change in humidity ratio, the elevated inlet temperature is reflected in the outlet temperature. The elevated inlet temperature coupled with the previously noted decreased efficiency, results in a normal operating temperature substantially above the 78.6° F. calculated for operation under optimum conditions.

Air temperature and humidity affect human comfort. An accepted guide for evaluating comfort factors is the temperature humidity index which is given by the formula:

$$THI = 0.4(Tdb + Twb) + 15.$$

Based upon the foregoing data, the temperature humidity index for a space cooled by the test model is 78.7. The comfort range is generally defined to lie between the temperature humidity index guide numbers 70 and 70. At the limits of the range, relatively few people are uncomfortable at 70 while relatively few people are comfortable at 79. An index of 75 represents comfort for approximately 50% of the population. It is seen, therefore, that the industry standard, operating at optimum performance, represents marginal comfort for the ASHRAE 1% design criteria in Phoenix, Arizona.

It would be highly advantageous, therefore, to remedy the foregoing and other deficiencies inherent in the prior art.

Accordingly, it is an object of the present invention to provide improvements in the art of evaporative space cooling systems.

Another object of the invention is the provision of means for increasing the evaporative efficiency of conventional type evaporative coolers.

And another object of this invention is to provide an evaporative cooler which will yield a greater temperature drop.

Still another object of this invention is the provision of means for decreasing the temperature humidity index number in connection with evaporative coolers.

Yet another object of the instant invention is to provide means for maintaining the continued performance of an evaporative cooler at a level nearer optimum than possible with prior art devices.

Yet still another object of the invention is the provision of a cooler having improved air flow characteristics.

And a further object of the immediate invention is to provide means to preserve the integrity of the pad and prevent undue deterioration thereof.

Still a further object of the invention is the provision of means to decrease the temperature of the inlet air to an evaporative cooler in certain unusual and common situations.

Yet a further object of the invention is to provide improvements of the above type which may be practiced in connection with commercially available prior art evaporative coolers.

And still another object of this invention is the provision of an evaporative cooler which is selectively spatially orientatable.

Yet still another object of the subject invention is to provide improved means for wetting the pads of an evaporative cooler.

SUMMARY OF THE INVENTION

Briefly, to achieve the desired objects of the instant invention, first provided are means for increasing the length of travel of the air stream through the pad. In accordance with a preferred embodiment of the invention, the length of travel of the air stream is increased by shroud means which divert the air stream from the normal path thereof to a circuitous path through the pad. In a more specific embodiment of the invention, the shroud means includes inlet control means for directing the entrance of the air stream into the pad through a predetermined inlet portion of the pad and outlet control means for directing the exit of the air stream from the pad through a predetermined outlet portion. The inlet control means includes an air impervious outer shroud for masking the entrance of the air stream into the pad and an air inlet formed therein in registry with the inlet portion of the pad. The air outlet control means includes an air impervious inner shroud masking the exit of the air from the pad and an air outlet formed in the inner shroud in registry with the outlet portion of the pad. Preferrably, the outlet portion of the pad is laterally displaced from the inlet portion of the pad whereby at least a portion of the circuitous path is in a direction generally perpendicular to the normal direction of the stream of air through the pad. Cooperating therewith are means, such as a higher speed or larger blower means, for moving the air stream in the circuitous path at a greater velocity than the velocity of the air stream in the prior art normal path. In addition, it is suggested that the width of the path be increased.

The foregoing improvements are responsible, when practiced in connection with the previously described prior art test model, for an increase in inlet air velocity from the standard 166 feet per minute to approximately 1208 feet per minute. The circuitous path extends the length of the air flow through the pad from the current 1.5 inches to approximately 13.6 inches. It is seen, therefore, that the air inlet velocity increases by a factor of 7.3 to 1 while the air flow length is increased by a factor of 9.1 to 1. Specific air flow remains relatively constant at 1633 cfm/ton. Air transit time within the pad is increased by 24% from the standard 0.045 seconds to 0.056 seconds.

Wet bulb depression error, a well known measure of evaporative efficiency, decreases as velocity increases. A graph illustrating the effects of air velocity on wet bulb depression error well known to those skilled in the art is the modified Arnold theory devised in 1936. According to the graph, the wet bulb depression error for air at the standard velocity of 166 feet per minute is approximately 8.0%. The wet bulb depression error for an air velocity of 1208 feet per minute, as suggested by the instant invention, is 0.8%.

The formula for web bulb depression, Tdb-Twb, is a significant portion of the formula for evaporative efficiency. Wet bulb depression is approximately equal to the theoretical maximum change in air temperature by the evaporation of water. Therefore, utilizing the above data, the performance of the test unit evaporative cooler, improved in accordance with the teachings of the instant invention, can be calculated. Under the same ASHRAE design criteria as utilized in connection with the test model, the improved evaporative cooler of the instant invention yields a temperature drop of 35.3° F. resulting in a discharge temperature of 73.7° F. Passing through the space to be cooled, the temperature will rise 7.3° F. to 81.0° F. and 73.0° F. wet bulb. Accordingly, the evaporative efficiency is increased to 93%. It is also noted that the temperature humidity index guide member is lowered to a substantially more comfortable 76.6.

Next provided by the instant invention are means for intermittent wetting of the pad. More specifically, the improvement includes timer means for alternating the distribution system between a delivery cycle during which liquid is delivered to the pad and an arrest cycle during which delivery of the liquid to the pad is suspended. The timer means may comprise a timer in series with the conventional pump. The delivery cycle precedes the arrest cycle and is initiated upon activation of the cooler by the conventional thermostat or other switch means. It has been determined, from actual measurements taken in connection with the test model, that the outlet temperature will drop 1° F. to 2° F. within one or two minutes after the flow of water to the pads has been discontinued. The temperature will remain below the normal outlet temperature for approximately 8.5 minutes. Therefore, it is suggested, in accordance with a preferred embodiment of the invention, that the delivery cycle be of approximately 1.5 minute duration and the arrest cycle be of approximately 8.5 minute duration. No technical explanation is known for the foregoing phenomenon other than empirical observation.

Further provided by the instant invention is an upstream shield for screening the pad from radiant energy and airborne contaminants. In accordance with a preferred embodiment of the instant invention, the shield includes a generally upright panel spaced from the pad to intercept the normal path of the air stream, thereby deflecting the stream to a circuitous path to reach the inlet side of the pad. In a more specific embodiment, the shield further includes a lower panel extending between the lower horizontal edge of the upright panel and the evaporative cooler housing and a pair of lateral panels extending between each upright edge of the upright panel and the evaporative cooler. Accordingly, the air is caused to enter at a height approximately equal with the top of the housing of the evaporative cooler. The foregoing improvement is also applicable for use with other types of air conditioning devices to protect the heat exchanger.

The immediate improvement is largely responsible for maintaining optimum operation of the evaporative cooler. Further, receiving air through an elevated opening, more nearly ensures the ingestation of air approximating ambient conditions. In a roof-top installation, as previously referenced, the inlet air will be approximately 6° F. to 7° F. lower than the prior art test model. In addition to preserving the integrity of the pads, the shield minimizes dust and other particulates entering the space to be cooled as is common with prior art devices especially during dust storms as frequently occur in arid and semi-arid regions.

Improved means for evenly distributing the water to the pad is also contemplated by the instant invention. Included is an elongate manifold which receives pressurized coolant liquid from the pump or other supply.

Spaced along the upper portion of the manifold are a plurality of orifices for dispensing the water in a plurality of pressurized jets. The jets are directed against a diffuser which dissipates the jets and disseminates the water to the upper edge of the pad. The diffuser, which includes an elongate deflection surface, may be incorporated along the upper inner edge of a conventional pad frame. In accordance with one embodiment of the invention, the manifold is in the form of an elongate tubular element supported by a splash shield depending from either end of the diffuser. Each end of the tubular element is closed and the pressurized water is introduced through a conventional T-arrangement at an intermediate location.

Further provided by the instant invention is an improved evaporative cooler housing usable in connection with the foregoing improvements or conventional prior art components. The improved housing is especially orientatable for discharging cooled air in a preselected vertical or horizontally directed stream. The housing includes a first reservoir for holding water when the side of the housing, including the outlet opening is positioned vertically, and a second reservoir for holding water when the side of the housing is positioned horizontally.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which:

FIG. 1 is a perspective view of a conventional prior art evaporative cooler incorporating the improved air flow means of the instant invention, one of the improved pad frames being exploded away for purposes of illustration;

FIG. 2 is a partial perspective view of a conventional prior art evaporative cooler generally corresponding to the view of FIG. 1 and showing an alternate embodiment of the instant invention;

FIG. 3 is a perspective view of the back side of the pad frame assembly illustrated in FIG. 1;

FIG. 12 is an alternate embodiment of an improved evaporative cooler of the instant invention;

FIG. 15A is a vertical sectional view taken along the line 15A—15A of FIG. 12;

FIG. 15B is a view generally corresponding to the view of FIG. 15A and showing the device thereof in an alternate special arrangement;

FIG. 15C is a view generally corresponding to the view of FIG. 15A and showing the apparatus thereof in yet another alternate special orientation;

FIG. 16 is a perspective view of yet another embodiment of the instant invention;

FIG. 17 is a fragmentary perspective view of a portion of a water circulation system useful in connection with several of the embodiments of the improved evaporative cooler of the instant invention;

DESCRIPTION OF THE PREFERRED EMBODIMENTS

Figure 4:
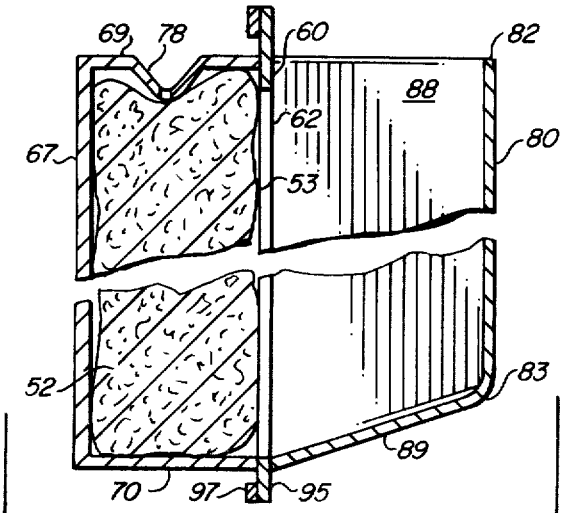
FIG. 4 is a vertical sectional view taken along the line 4—4 of FIG. 1, an intermediate portion thereof being broken away for purposes of illustration.

Turning now to the drawings in which like reference numerals indicate corresponding elements throughout the several views, attention is first directed to FIG. 1 which shows a conventional evaporative prior art cooler, such as the previously referenced test model, generally designated by the reference character 20. Cooler 20 includes housing 22 comprising top 23 and bottom 24 separated by vertical corner members 25.

The vertical corner members 25, which are angular in horizontal cross-section, together with a downturned peripheral edge 27 of top 23 and upturned peripheral edge 28 of bottom 24, establish two pair of opposed upright sides 29 and 30. Although only one side 29 and one side 30 are specifically illustrated, it is understood that the opposed sides, not illustrated, are identical in appearance to the respective illustrated sides. An opening 32 is defined in each side by opposed upper and lower edges 33 and 34, respectively, and opposed lateral edges 35 and 37.

Located within the housing is blower means 38 which draws a stream of air through each opening 32 in a normal path generally perpendicular to the respective sides 29 and 30 as represented by the arrowed line A. Blower means 38 includes housing 39, which in accordance with conventional practice, encloses a centrifugal impeller and has an electric motor secured thereto. Drive means, between the impeller and the motor, is commonly a belt encircling a pair of pulleys, one secured to the drive shaft of the motor and the other secured to the driven shaft of the impeller. Chosen for purposes of illustration is an evaporative cooler of round discharge configuration. Accordingly, housing 38 includes downwardly directed discharge duct 40 passing through an appropriately shaped and sized opening 42 in bottom 24. For purposes of orientation, it is noted that sides 30 are opposite the inlet openings of housing 38 while sides 29 are perpendicularly oriented.

Normally, a pad frame assembly is secured to each side 29 and 30. The conventional assembly includes a louvered panel member detachably securable to the respective sides and bearable upon lower edge 34. An air pervious, liquid absorbing evaporation pad is carried by each assembly and spans each opening 32. Bottom 24 functions as a reservoir for holding a supply of coolant liquid, usually water. A liquid circulation system delivers water from the reservoir to the several pads. Traditionally, the circulation system includes a trough positioned above the pad and having a plurality of spaced openings therealong. A pump, resting upon bottom 24, supplies liquid to a conduit having a discharge end located above the trough. A float, responsive to liquid level within the reservoir, controls a valve at the discharge end of a supply conduit usually connected at the inlet end to the water supply system for the residence or other structure. The pump and the blower motor are activated in response to the closing of a switch, either manually operable or automatically responsive to a preselected environmental condition.

The foregoing description, presented for purposes of orientation, is intended to be generally representative of conventional prior art evaporative coolers, such as the previously described test unit. Various components have been specifically illustrated and described. A thorough understanding of the device and components not particularly illustrated and described, will be readily visualized and understood by those skilled in the art to which the instant invention pertains.

A feature of the instant invention is the improved pad frame assembly generally designated by the reference character 50 and illustrated in FIGS. 1 and 3. In accordance with an immediately preferred embodiment, assembly 50, which carries air pervious, liquid absorbing pad 52 having outer side 53, inner side 54, opposed upper and lower horizontal edges 55 and 57, respectively, and opposed upright edges 58 and 59, is sized and shaped to be used in connection with opening 32 without modification of cooler 20. Means carried by assembly 50 increases the evaporative efficiency of cooler 20 by increasing the length of travel of the air stream through pad 52. More specifically, the length of travel of the air stream is increased by shroud means which diverts the air stream from the normal path thereof to a circuitous path.

In the embodiment of the invention illustrated in FIGS. 1 and 3, the shroud means includes an air impervious outer shroud 60 having opening 62 lying between parallel edges 63 and 64. Opening 62 is vertically elongate with edges 63 and 64 being substantially parallel to edges 58 and 59 of pad 52. Shroud 60, which masks the entrance of the air stream into pad 52, functions as control means for directing the air stream into the pad through opening 62 which functions as an air inlet. The air stream actually enters pad 52 through an inlet portion 65 of the outer or normal inlet side 53 which is in registry with opening 62.

The shroud means further includes an air impervious inner shroud 67 projecting inwardly from outer shroud 60 and sized to be received through opening 32. Shroud 67, which envelops pad 52, is generally box-like having upright element 68, upper and lower horizontal elements 69 and 70, respectively, and upright elements 72 and 73. An opening 74 is formed in each upright element 72 and 73. In general similarity to outer shroud 60, inner shroud 67 functions as air outlet control means for directing the exit of the air stream from the pad through a determined outlet portion thereof. In the embodiment under consideration, the outlet portion of pad 52 is defined by the upright edges 58 and 59 which are in registry with respective openings 74. It is noted that each opening 74 is vertically elongate and lies between parallel edges 75 and 77 which are parellel to edges 63 and 64 of opening 62.

Openings 74 are laterally displaced from opening 62 with respect to the normal air flow as represented by the arrowed line A. The stream of air entering pad 52 through inlet portion 65 and exiting through outlet portions 52 follows the circuitous path diagrammatically represented by the arrowed lines B. A portion of the circuitous path represented by the arrowed lines B is perpendicular, or lateral, to the normal path represented by the arrowed line A. Formed in the upper horizontal element 69 is trough 78 which, in accordance with conventional practice, has a plurality of openings therealong for distributing water along the edge 55 of pad 52 after receiving water from the normal circulation system. For maximum efficiency, it is suggested that the thickness of pad 52 be increased to a dimension greater than the conventional pads. Calculations and observations tend to indicate an optimum of four inches.

An evaporative cooler of the immediate type, as set forth in connection with the previously described test model, has an exit duct area for approximately four hundred square inches. The total area of the eyes, the inlets at either end of the impeller, have a generally equivalent area of approximately four hundred and twenty-seven square inches. In order to increase evaporative efficiency of the cooler, balance the pressure drop of the air across the pad and increase the velocity of the air stream, it is contemplated that the total inlet area provided by the several openings 62 more nearly approximate that of the exit duct area than the total of the openings 32 as set forth by the prior art. Calculations suggest a total inlet area of approximately five hundred and eighty-four square inches. The total area of the air outlets, openings 74, should be approximately the same. Compensation for the small pressure drop through the pad frames is readily accomplished by a change in size of the pulleys associated with the drive motor and the impeller to yield an approximate ten percent increase in impeller rotation speed.

Also contemplated by this invention is an upstream shield for screening the pad from direct and reflected radiant energy and from airborne particulates and contaminants. In the immediate embodiment of the invention, as viewed in FIGS. 1 and 3, the shield, which is integral with improved pad frame assembly 50, includes generally upright panel 80 having opposed upper and lower horizontal edges 82 and 83, respectively, and opposed upright edges 84 and 85. Upright panel 80 is held in substantially parallel spaced relationship with outer shroud 60 by upright panels 87 and 88 extending inwardly from edges 84 and 85, respectively. A lower panel 89 extends between lower edge 83 and outer shroud 60. It is noted that lower panel 89 extends downwardly inward from edge 83. Accordingly, the usual louvers across the inlet opening may be discarded, since any water escaping pad 52 through opening 62 will be redirected in the direction of the reservoir provided in bottom 24. Inlet opening 90 is defined in the top of the shield between the upper edge 82 of upright panel 80 and outer shroud 60 and the upper edges of the upright panels 87 and 88.

FIG. 2 illustrates alternate means for screening and protecting the pad, which in general similarity to the previously described embodiment, includes a shield having upright panel 80, having upper and lower edges 82 and 83, respectively, and upright edges 84 and 85. Upper panel 92 and lower panel 93 extend between edgess 82 and 83, respectively, and outer shroud 60. Accordingly, an air inlet 94 is defined along either upright edge of the shield.

The currently preferred attachment means for affixing pad frame assembly 50 to cooler 20 is shown in FIG. 4. Outer shroud 60 terminates with outwardly projecting peripheral flange 95. During assembly, flange 95, which projects beyond opening 32, is brought into juxtaposition with the respective upright side 29 or 30 of housing 22. Conventional fasteners, such as sheet metal screws, are used to affect the securement. It is suggested that a gasket 97 is positioned between flange 95 and housing 22 to ensure that all air entering cooler 20 passes through the inlet portion 65 of pad 52. Also noted in the immediate illustration is trough 78 integrally formed in upper horizontal element 69 of inner shroud 67.

Figure 5:
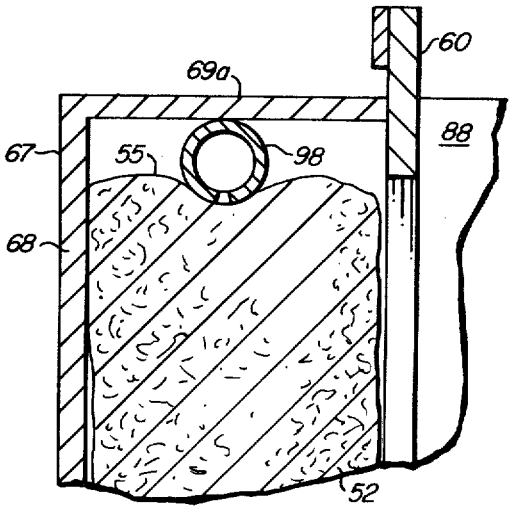
FIG. 5 is a view generally corresponding to the upper portion of FIG. 4 and showing an alternate embodiment thereof.

An alternately preferred inner shroud 67 having a modified upper horizontal element **69*a* is seen in FIG. 5. Alternate upper horizontal element 69*a*, being without integral trough 78, performs the function of enclosing pad 52 and preventing the escape of air through upper edge 55. Liquid to pad 52 is delivered through conduit 98 residing between upper edge 55 of pad 52 and upper element 69. In accordance with conventional practice, a plurality of water delivery apertures are spaced along conduit 98**.

The pad frame assemblies, herein described in connection with the instant invention, are variously fabricated in accordance with techniques and skills considered to be conventional within the art to which the invention pertains. For example, the apparatus may be fabricated of sheet metal components which are ultimately bonded together such as spot welding. Alternately, the structure may be unitarily molded of any suitable synthetic material, especially resinous plastics. It is equally apparent that either the shroud means or the screening means may be utilized separately. When utilized without the shroud means, the shield may include an outwardly projecting flange, such as flange 95.

Figure 6:
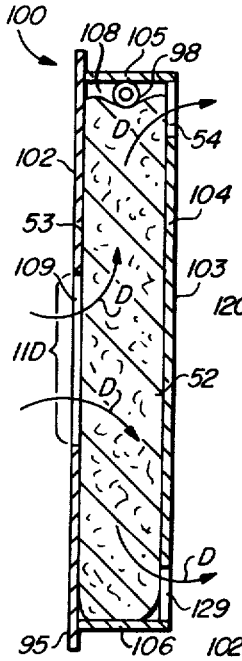
FIG. 6 is a vertical sectional view of alternate shroud means for diverting the air stream from the normal path thereof to a circuitous path.
Figure 7:
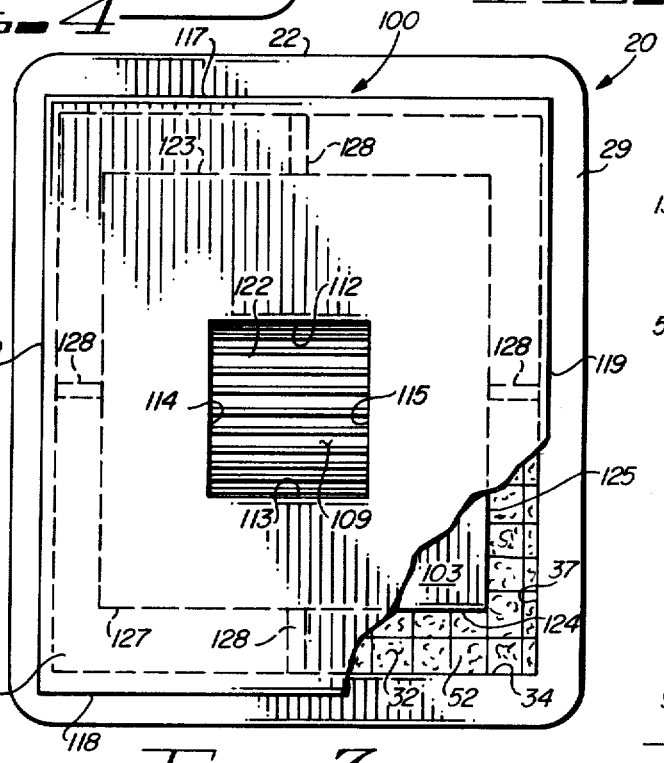
FIG. 7 is a frontal vision view of the embodiment of FIG. 6 as it would appear when secured to a conventional evaporative cooler.

With reference to FIGS. 6 and 7, there is seen an alternate pad frame assembly generally designated by the reference character 100, which, in general similarity to previously described embodiments, includes outer shroud 102 and inner shroud 103 having pad 52 therebetween. Inner shroud 103, being generally box-like, includes upright element 104, upper and lower horizontal elements 105 and 107, respectively, and upright side elements 108, only one of which is specifically illustrated. Opening 109, in outer shroud 102, registers with inlet opening 110 on outer side 53 of pad 52. As specifically noted in FIG. 7, opening 109 is generally rectangular and is defined by upper and lower horizontal edges 112 and 113, respectively, and spaced apart vertical edges 114 and 115 equally spaced from the upper edge 117, lower edge 118, upright edge 119 and upright edge 120, respectively, of outer shroud 102. A conventional louvered grille 122 extends across opening 109 for obvious reasons. Upright element 104 of inner shroud 103 is shaped similar to opening 32 but is bounded by upper edge 123, lower edge 124 and upright edges 125 and 127 which are spaced from the corresponding edges of opening 32. A plurality of relatively narrow tabs 128 unite upright element 104 with the other elements of inner shroud 103. In accordance with the immediate embodiment, the outlet portion of pad 52 is defined as the terminal peripheral portion 129 of inner side 54. As determined by the immediate shroud embodiment, air flow through pad 52, which includes a portion thereof lateral to the normal path of the air stream, is shown by the arrowed lines D.

Figure 8:
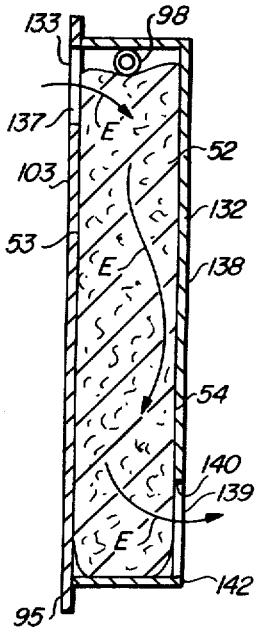
FIG. 8 is a view generally corresponding to the view of FIG. 6 showing an alternate embodiment thereof.
Figure 13:
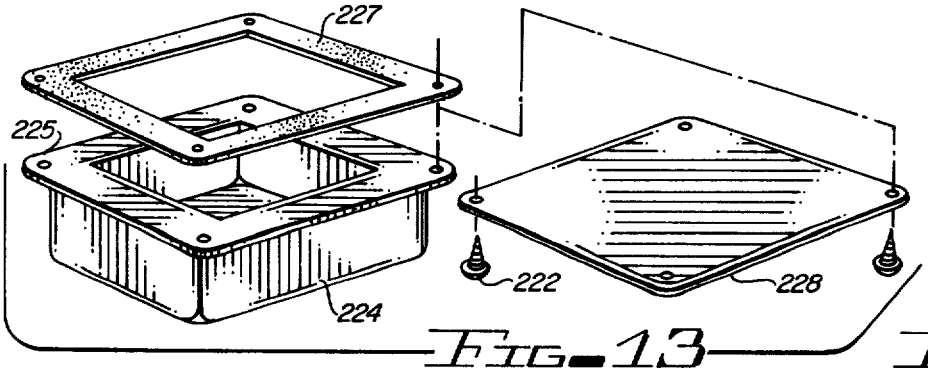
FIG. 13 is an exploded perspective view of a sump useful in connection with the improved cooler of FIG. 12.
Figure 9:
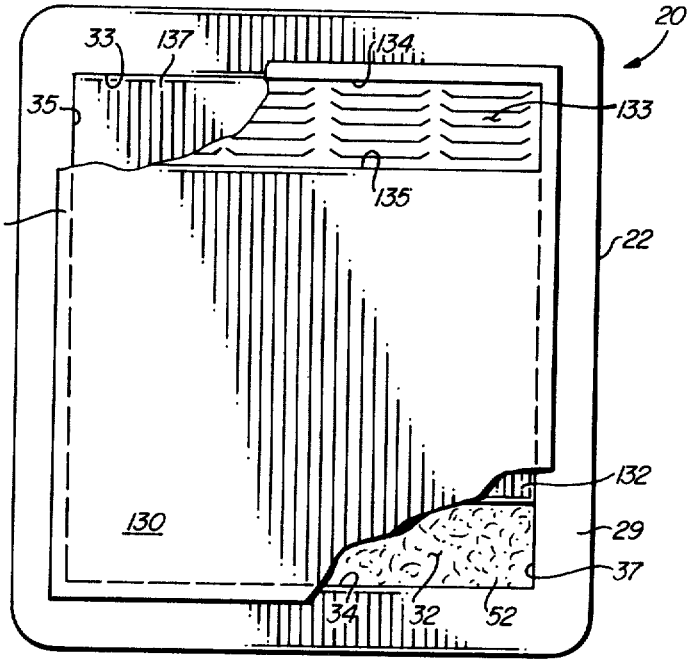
FIG. 9 is a front elevation view of the shroud means of FIG. 8 as it would appear when secured to a conventional cooler.

Yet another alternate embodiment of the shroud means, constructed in accordance with the teachings of the instant invention and including outer shroud 130 and inner shroud 132, is illustrated in FIGS. 8 and 9. Outer shroud 130 includes elongate opening 133 having parallel longitudinal edges 134 and 135. Opening 133, the longitudinal axis of which is parallel to edges 33 and 34 of opening 32, registers with the inlet portion 137 of the outer side 53 of pad 52.

Inner shroud 132 includes upright element 138 having elongate opening 139 with parallel longitudinal edges 140 and 142. The longitudinal axis of opening 139 is parallel to the longitudinal axis of inlet portion 137. Edge 134 of opening 133 approximately coincides with edge 133 of opening 32 while edge 142 of opening 139 approximately coincides with edge 34 of opening 32. Accordingly, air flowing through pad 52 is directed laterally from the normal path thereof as described by the arrowed lines E in FIG. 8.

Various changes and modifications to the embodiments of the shroud means herein particularly chosen for purposes of illustration will readily occur to those skilled in the art. Generically, each shroud means includes an inlet opening and a laterally offset outlet opening. In the embodiments of FIGS. 1 and 6, the lateral offset of approximately one-half the span of the pad. FIG. 8 illustrates an embodiment in which the lateral offset approximates the full span of the pad. Special orientation of the several embodiments is considered to be inherent within the concept of the invention. For example, the embodiment of FIG. 1 may be alternately oriented such that the inlet opening extends horizontally and the outlet openings are proximate the top and the bottom of the pad frame assembly. Similarly, the embodiment of FIGS. 8 and 9 may be rotated such that the inlet opening is near the lower edge or either upright edge of opening 32. The louvered grille may be optionally used in connection with any embodiment.

The majority of air drawn into a conventional cooler having pads on each of the four upright sides, is drawn through the pads opposite the inlet openings of the blower housing. Experimentation would tend to indicate that pads on the other two sides may be omitted without sacrifice of efficiency of the unit. This modification also serves to increase the velocity, and correspondingly, the evaporative efficiency moving through the two remaining pads. It is suggested that the remaining pads be increased in thickness to provide greater transit time for the air.

Figure 10:
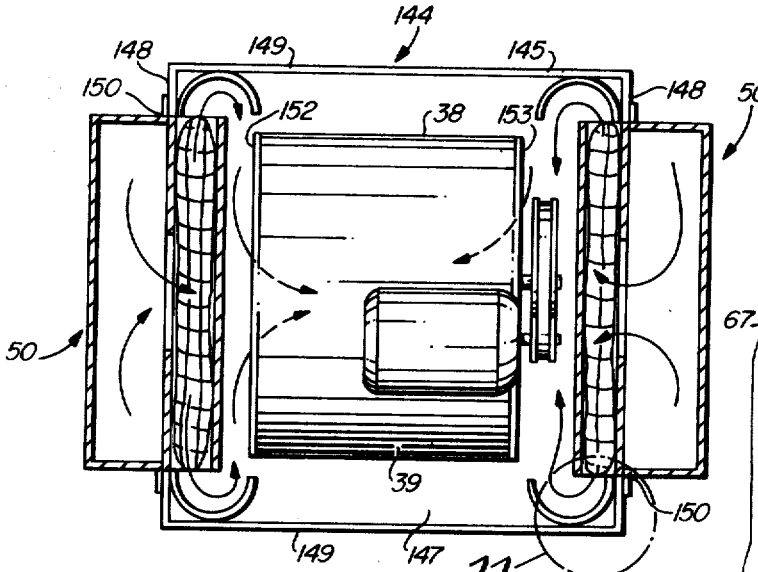
FIG. 10 is a horizontal sectional view of an improved evaporative cooler embodying the teachings of the instant invention.
Figure 11:
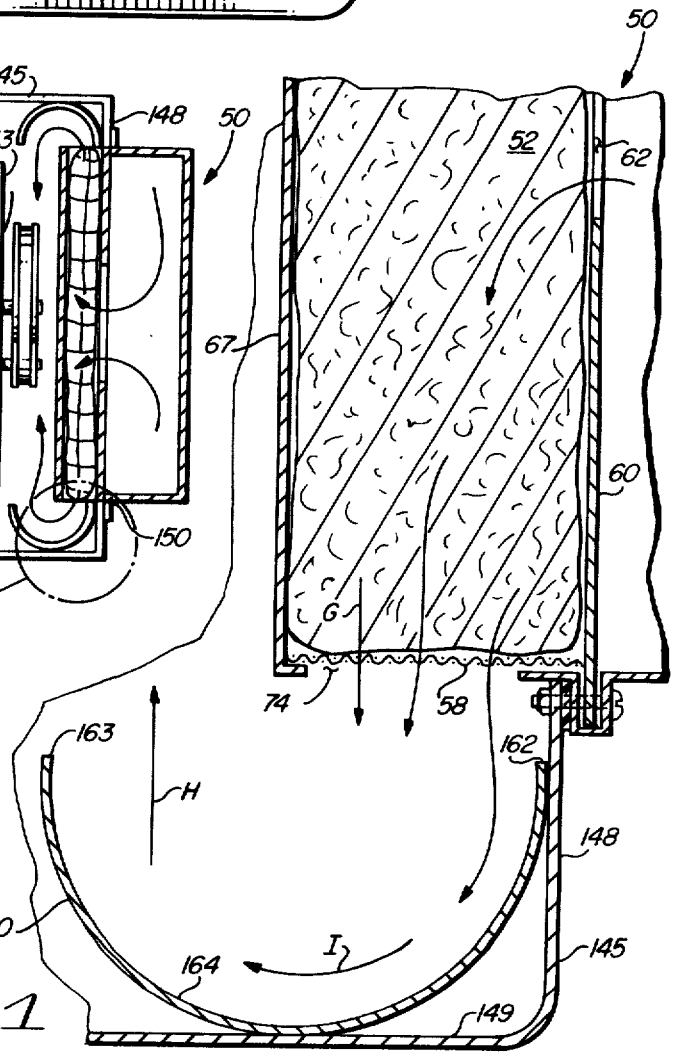
FIG. 11 is an enlarged fragmentary view taken from the inset 11 in FIG. 10.

FIG. 10 illustrates an improved evaporative cooler of the instant invention generally designated by the reference character 144 and having housing 145. In general analogy to the prior art, housing 145 includes bottom 147, two pair of upright sides 148 and 149 extend upwardly from bottom 147. Sides 149 are solid. Sides 148 are provided with inlet openings 150 and fitting with, for purposes of illustration, previously described pad frame assemblies 50. Conventional blower means 38 is mounted within housing 145. It is noted that the inlet ends 152 and 153 of blower housing 39 face in directions toward respective pad frame assemblies.

Air, exiting from outlet portion 58 of pad 52 through opening 74 in inner shroud 67, moves in the direction of the arrowed line G. Air being drawn toward the opening in end 153 of blower housing 39, moves in a diametrically opposed direction as indicated by the arrowed line H. An improvement of the instant invention is baffle means for receiving air from discharge surface 58 moving in the direction of arrowed line G and directing the air in a direction indicated by the arrowed line H toward the blower means 38. In accordance with the immediately preferred embodiment, the baffle means includes an elongate element 160 having longitudinal edges 162 and 163. Edge 162 is substantially parallel to surface 58. Element 160 further includes arcuate deflecting surface for altering the course of the air flow as indicated by the arrowed line I and forming a transition between the directions indicated by arrowed lines G and H. Water, entrained in the air stream moving in the direction of arrowed line G as the result of passing through pad 52, is precipitated out as droplets upon striking surface 164 as the result of the change in direction of the air stream as indicated by the arrowed line I. In response to gravity, the droplets run down surface 164 to the lower edge (not specifically herein shown) of elongate element 160 and fall therefrom into the reservoir formed in bottom 147. The removal of the excess water does not effect the temperature of the discharge air from evaporative cooler 144, but does prevent excess moisture from reaching the space to be cooled.

Attention is now directed to FIG. 12 which illustrates an evaporative cooler, generally designated by the reference character 200, and embodying the foregoing and other teachings of the instant invention. As further seen in FIG. 15A, cooler 200 includes housing 202 having a pair of opposed upright sides 203, each of which includes an opening 204 to which is fitted previously described pad frame assembly 50. Housing 202 further includes sides 205, 207, 208 and 209 as will be described in further detail presently. Blower means 38 having blower housing 39 with discharge duct 40, is carried within housing 202 such that discharge duct 40 communicates with opening 210 in side 207 for discharge of cooled air in a horizontal direction as indicated by the arrowed line K. Also noted is inlet opening 154 in inlet end 153. It is understood that a similar opening 154 resides in inlet end 152.

The several sides of housing 202 are secured together along water-tight seams. Accordingly, a liquid holding reservoir of prior art character is formed in the bottom of housing 202 without regard to special orientation thereof, provided sides 203 remain as upright sides. For the immediate purpose, openings 204 are square and pad frame assembly 50 is corresponding shaped to facilitate attachment of assembly 50 in proper orientation without regard to orientation of housing 202.

FIG. 15A illustrates a special orientation of housing 202 such that the direction of the discharge air stream, represented by the arrowed line K, is vertical. In this orientation, side 205 is the bottom adjacent reservoir 212. FIG. 15B illustrates an orientation in which side 207 is the bottom and the direction of the discharge air stream is vertically downward as represented by the arrowed line L. When the direction of the discharge air stream is vertically upward, housing 202 is oriented with side 209 as the bottom. If desired, the apparatus may be oriented such that side 208 functions as the bottom.

Circulation means for the immediate embodiment includes a pump 213 of the conventional type manufactured for the immediate purpose, a water conduit 98 in each pad frame assembly 50 as previously described in connection with FIG. 5, and a flexible tube 214 communicating between pump 213 and each conduit 98. It is apparent that the pump 213 may be positioned in reservoir 212 in accordance with conventional techniques, without regard to which side forms the bottom.

Figure 14:
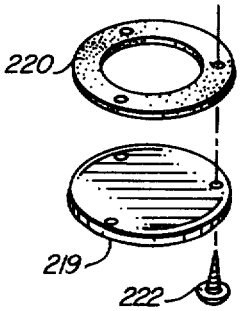
FIG. 14 is a cover plate useful in connection with the improved cooler of FIG. 12.

With further reference to FIG. 12, it is seen that make up water is supplied to reservoir 212 by conventional float actuated valve 215 and supply line 217 extending from any convenient source. As manufactured, housing 202 may include appropriately placed knock-out slugs 218. After orientation is determined by the user, the appropriate knock-out slug 218 is removed and float actuated valve 215 installed. Should the housing be subsequently re-orientated requiring the removal of a second knock-out slug 218 for relocation of float actuated valve 215, the previous opening is readily sealed by the means illustrated in FIG. 14. Illustrated is cover plate 219 and sealing gasket 220 which are secured over the unwanted opening by conventional sheet metal screws 222.

The instant invention also contemplates means for periodically removing minerals and other contaminants which, as well known to those skilled in the art, accumulate within the recirculated water. Being heavier than the water, the contaminants tend to settle to the bottom of reservoir 212. For this purpose, a lowered sump is formed in reservoir 212. In accordance with the immediately preferred embodiment of the invention, the housing 202 is provided with a plurality of appropriately placed second knock-out slugs 223. Securable to the opening formed by the removal of the selected knock-out slugs 223 is dish-shaped sump 224. Sump 224 terminates with outwardly directed peripheral flange 225 which is sealingly secured to the side of the cooler by gasket 227 and conventional sheet metal screws 228. As with the float actuated valve, the opening may be covered by cover plate 228 and gasket 227.

As seen in FIGS. 15A, 15B, and 15C, sump 224 resides at a lower elevation than reservoir 212. A second pump 229 residing within sump 224, is periodically activated, either manually or on timer, to expell the settlings within sump 224.

FIG. 16 illustrates housing 202 as it would appear in combination with a conventional prior art cooler pad assembly generally designated by the reference character 230. It is understood that either pad frame assembly 50 of the instant invention, or prior art pad frame assembly 230 may be provided with either conduits 98 or troughs 78 as previously described.

Figure 18:
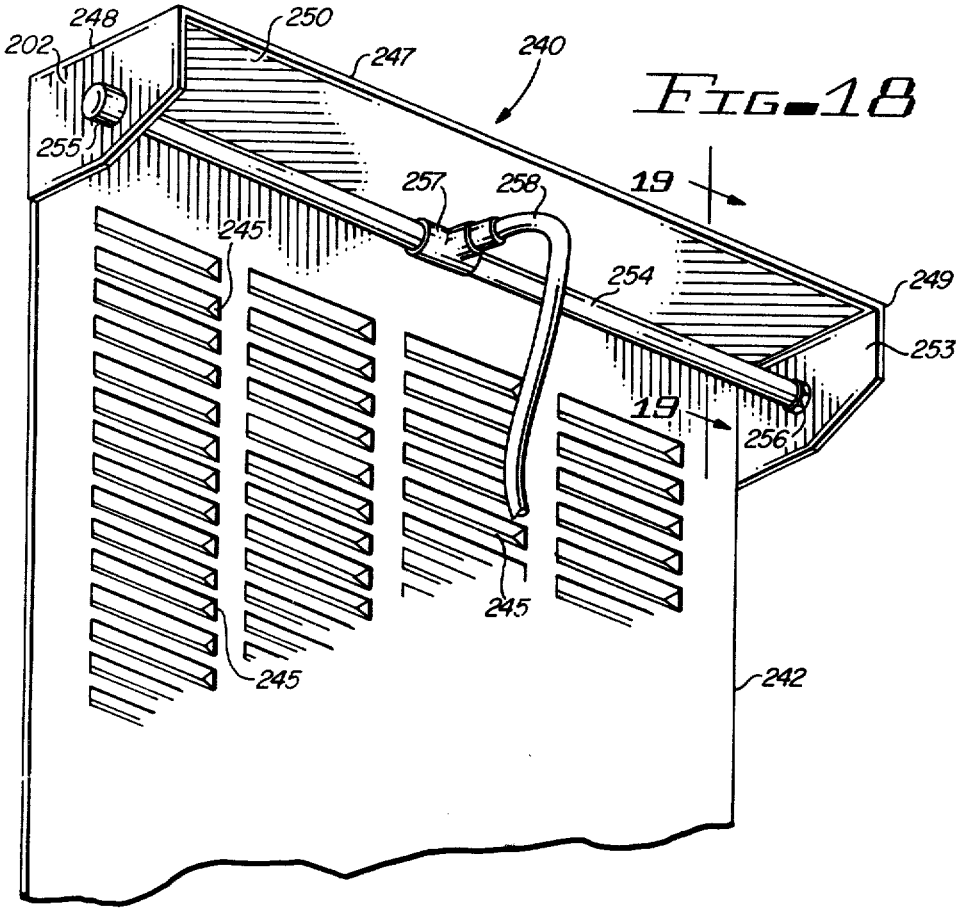
FIG. 18 is a fragmentary perspective view of the upper internal portion of a conventional pad frame incorporating improved distribution means of the instant invention.

Turning now to FIG. 18, there is seen improved distribution means, generally designated by the reference character 240 for disseminating water to the pad. For purposes of illustration, the improved distribution means 240, which comprises a portion of the circulation system, is illustrated in connection with a conventional pad frame 242 having an upper edge 243 and an inner side 244 and provided with the traditional louvers 245. For clarity of illustration, the pad has been omitted, but as will be recognized by those skilled in the art, the pad includes an upper edge terminating approximately coincident with the uppermost louvers 245.

Figure 19:
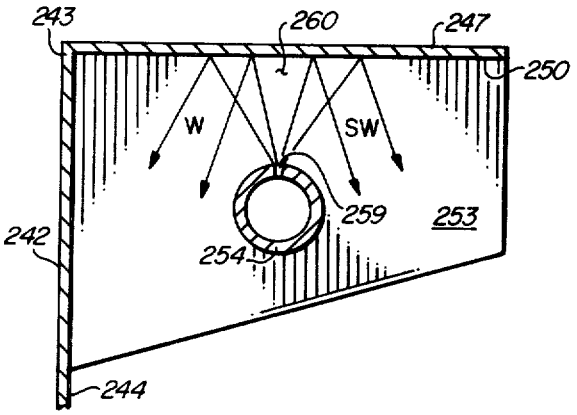
FIG. 19 is an enlarged vertical sectional view taken along the line 19—19 of FIG. 18.

In accordance with the immediately preferred embodiment of the invention, as also seen in FIG. 19, distribution means 240 includes an inwardly directed diffuser 247 extending along upper edge 243 and terminating with ends 248 and 249. Carried on the under side of diffuser 247, is elongate deflection surface 250 as will be described in further detail presently. Flanges, defining splash shields 252 and 253, depend from ends 248 and 249, respectively.

Elongate tubular element 254, having closed ends 255 and 256, extends between and is carried by flanges 252 and 253. For this purpose, flanges 252 and 253 are provided with openings through which closed ends 255 and 256, respectively, project. Tee 257, inserted into elongate tubular member 254 at an intermediate location, provides an inlet for receiving pressurized water or other coolant liquid from the conventional source through supply line 258. A plurality of spaced orifices 259 extend through the upper portion of tubular member 254. Although only one such orifice 259 is illustrated in FIG. 19, it will be apparent to those skilled in the art that a plurality of such orifices 259 are regularly spaced and extend through the side wall of member 254.

In operation, pressurized water is fed into tubular element 254 through supply line 258 and tee 257. Initially, the liquid fills tubular element 259. Subsequently, the liquid is discharged as a plurality of jets 260 directed toward deflection surface 250. Upon striking deflection surface 250, the jets 260 are dissipated and disseminated to the upper edge of the pad which preferably resides immediately below tubular element 254. The water disseminated from deflection surface 250, as illustrated by the arrowed lines W in FIG. 19, is sufficiently diffused to strike the upper edge of the pad in a random, evenly distributed pattern, Thus, uniform distribution of the water to the pad is assured thereby preventing the formation of rivulets. Splash shields 252 and 253 eliminate the lateral escape of the diffused liquid.

Figure 20:
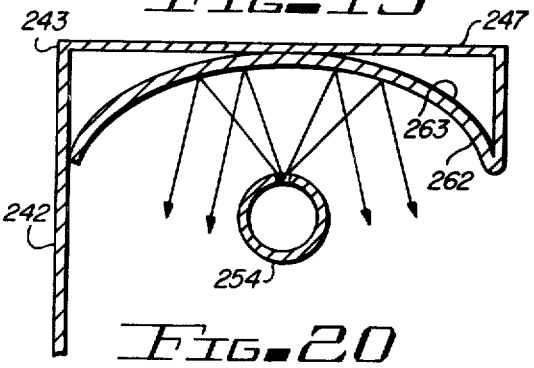
FIG. 20 is a view generally corresponding to the view of FIG. 19 and illustrating an alternate embodiment thereof.

The embodiment of FIGS. 18 and 19 illustrate deflection surface 250 as being an integral, flat surface of deflector 247. FIG. 20 illustrates an alternate embodiment of the invention in which deflection surface 262, being arcuate in cross-section, is carried by intermediate element 263. Various fabrication procedures for forming arcuate surface 262, as illustrated in FIG. 20, will readily occur to those skilled in the arts of sheet metal and evaporative coolers to which the instant invention pertains. It will also be appreciated that the various elements of the improved distributions means 240 may be integrally molded with pad frame 242, in accordance with conventional plastic fabrication techniques. Preferably, elongate tubular member 254 is fabricated of polyvinyl chloride, or other noncorrosive, synthetic or natural material.

Figure 21:
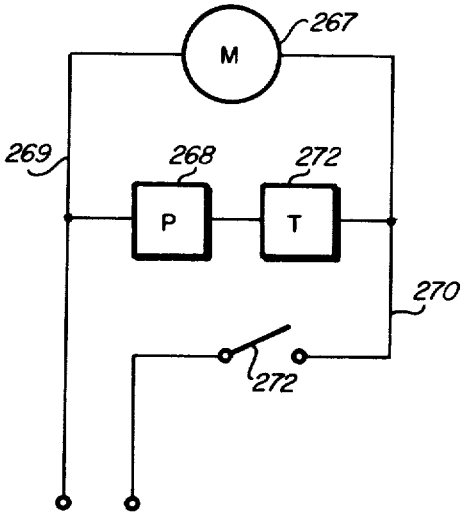
FIG. 21 is a schematic of a conventional electrical circuitry and including improvements of the instant invention.

FIG. 21 schematically illustrates a conventional blower motor 267 and conventional pump 268 as associated with prior art commercially available evaporative coolers. Typically, motor 267 and pump 268 are connected to a source of electrical energy through lines 269 and 270. Activation is controlled by manually operative or environmentally sensitive switch 272.

In accordance with the instant invention, timer 272 is placed in series with pump 268. Timer 272 is of a commercially available type which, when activated, will sequence through open and closed cycles thereby causing intermittent operation of pump 268. Further, timer 272 is automatically resetable. That is, upon being deenergized, the timer will automatically assume the beginning of a preselected cycle. Accordingly, when switch 272 is closed, pump 268 and motor 267 will be energized simultaneously. Thereafter, the distribution system will alternate between a delivery cycle during which liquids delivered to the pad and an arrest cycle during which delivery of the liquid to the pad is suspended. The intermittent wetting of the pads provides improved efficiency as herein before described.

The improvements illustrated and described in connection with FIGS. 18–21, taken together, are especially useful when practiced in connection with the previously described improved pad frame assembly of the instant invention. The improvements, taken singularly or in combination, are also usable in combination with evaporative coolers of alternate design, such as conventional commercially available coolers.

Various changes and modifications to the embodiments herein chosen for purposes of illustration will readily occur to those skilled in the art. For example, while the improvements have been described in connection with a generally cubical cooler configuration, those skilled in the art will readily adapt the teachings to coolers of other configuration, such as circular. To the extent that such modifications and variations do not depart from the spirit of the invention, they are intended to be included within the scope thereof which is assessed only by a fair interpretation of the following claims.

Having fully described and disclosed the present invention and alternately preferred embodiments thereof, in such clear and concise terms as to enable those skilled in the art to understand and practice the same, the invention claimed is:

1. In an evaporative cooler including a housing having an upright surface with an opening therein, an air pervious, liquid absorbing evaporative pad spanning said opening and having a discharge surface, means for supplying liquid to said pad, and blower with said housing means for drawing a stream of air through said pad, said stream of air exiting said pad in a direction generally normal to said discharge surface and having droplets of said liquid entrained therein, improvements therein for settling said droplets from said air stream, said improvements comprising:

baffle means downstream of said discharge surface for receiving said air stream thereagainst, said baffle means being generally elongate and having a longitudinal edge substantially parallel to the discharge surface of said pad and being generally arcuate in cross-section such that the direction of said air stream is altered to flow in a substantially opposite direction.

2. The improvements of claim 1, wherein said baffle means includes a deflecting surface for altering the direction of said stream of air.

3. The improvements of claim 2, wherein said deflecting surface directs said air stream toward said blower means.

4. The improvements of claim 1, wherein said evaporative cooler further includes a liquid holding reservoir and said baffle means includes a lower edge positioned over said reservoir, whereby said droplets settled out of said air stream on said baffle means move in response to gravity to said lower edge and drop therefrom into said reservoir.

* * * * *